US005095976A

United States Patent [19]

Appleton

[11] Patent Number: 5,095,976

[45] Date of Patent: Mar. 17, 1992

[54] TUBING SAND PUMP

[76] Inventor: Billy D. Appleton, P.O. Box 1213, Snyder, Tex. 79549

[21] Appl. No.: 268,804

[22] Filed: Nov. 8, 1988

[51] Int. Cl.[5] ..... E21B 37/00

[52] U.S. Cl. ..... 166/105.1; 166/107; 166/311; 175/234

[58] Field of Search ..... 166/311, 99, 105.1, 166/105.2, 105.3, 105.4, 107-110; 175/234

[56] References Cited

U.S. PATENT DOCUMENTS

| | | | |
|---|---|---|---|
| 1,867,833 | 7/1932 | Hill | 175/234 |
| 2,168,729 | 8/1939 | Cavino | 166/110 |
| 2,237,686 | 4/1941 | Parr | 166/107 |
| 3,371,729 | 3/1968 | Carr | 175/321 X |
| 3,804,185 | 4/1974 | Mason | 175/297 |
| 4,190,113 | 2/1980 | Harrison | 166/311 |
| 4,421,182 | 12/1983 | Moody et al. | 166/105.1 X |
| 4,478,285 | 10/1984 | Caldwell | 166/311 |
| 4,493,383 | 1/1985 | Williams et al. | 175/234 |
| 4,721,156 | 1/1988 | Campbell | 166/99 |

FOREIGN PATENT DOCUMENTS

| | | | |
|---|---|---|---|
| 255327 | 1/1964 | United Kingdom | 175/234 |

*Primary Examiner*—Hoang C. Dang
*Attorney, Agent, or Firm*—Wendell Coffee

[57] ABSTRACT

A sand pump for an oil well includes a tail pipe connected to a barrel. A swab on a mandrel is reciprocatingly operated within the barrel to draw fluid upward from the bottom of the tail pipe. A flap valve at the bottom of the tail pipe and a ball check valve at the top of the tail pipe and below the barrel prevent debris and fluid caught within the pump from running backward through the tail pipe or the barrel. A traveling ball check valve is located immediately above the swab within a knocker on the mandrel to force the fluid upward. A double action swab is used on the mandrel to wipe the barrel bore clean to reduce problems with the sand which is within the liquid being pumped. Also, square shoulders on working parts are used to prevent guiding sand into areas having close tolerance. The fluid openings on the barrel bore are small and restricted so that the velocity of the movement of the mandrel is restricted. Fluid openings around the traveling value are small and restricted to provide sufficient velocity and turbulence of the liquid to flush sand and debris away.

2 Claims, 2 Drawing Sheets

TUBING SAND PUMP

BACKGROUND OF THE INVENTION (1) Field of the Invention

This invention relates to oil wells, and more particularly to a tubing cleanout tool commonly called a sand pump. Oil field workers who work over or repair producing oil wells are ones having ordinary skill in this art.

(2) Description of the Related Art

Sand pumps and cleanout pumps have been known for many years, e.g., PARR, U.S. Pat. No. 2,237,686, issued in 1941, shows a cleanout pump having a flap valve in the bottom with a piston carrying a ball valve (Also see REYNOLDS, U.S. Pat. Nos. 2,785,756). HARRISON, 4,190,113, issued in 1980, and WILLIAMS ET AL, 4,493,383, issued in 1985, disclose sand pumps particularly adapted to be run upon a drill stem or a tubing string which include a hexagonal mandrel at the top of the barrel so that rotational motion can be imparted to the cleanout tool.

Sand has been a problem in these type tools. One of the primary purposes of the tool is to remove sand from the well as well as other debris. Sand in the tool causes problems. The problem with sand in pumps has been recognized for considerable time, e.g., the patent to HOPKINS ET AL in 1922, U.S. Pat. No. 1,423,935 has a side chamber for an oil well pump to catch the sand. COOK's patent in 1964, U.S. Pat. No. 3,138,215 for a sand pump was concerned that the pump would be locked down by the sand.

There have been many patents issued on cleanout tools of this type. Also, many have been on the market commercially. However, the above indicate some of the problems involved with the sand pump, and also, some of the solutions previous workers have sought. It is noted that HARRISON disclosed a screen below the pump area to prevent large particles from entering the pump section of the cleanout tool.

SUMMARY OF THE INVENTION (1) Progressive Contribution to the Art

This invention provides a cleanout tool wherein a double acting tubing swab is used within the barrel bore as the piston. The double acting tubing swab is readily available on the market and will wipe the bore of the barrel clean of sand on both the up stroke and down stroke. Also, it does not have the rigidity of metal parts; and therefore, will not lock down or become stuck within the barrel bore. It is found that it is particularly adaptable for use in this service.

Also, it has been found that close fitting parts within the barrel bore are desirable because of the inherent design considerations. I.e., the non-round hexagon mandrel will have a diameter over two-thirds of the barrel diameter. To have a knocker on the bottom of the mandrel to hold the swab holder and the ball valve, the knocker itself will have such a large diameter that there is close tolerance to the barrel bore. Therefore, if the top of the knocker is beveled, it will tend to guide grains of sand between the knocker and the barrel bore. If sand is wedged in this area, the tool will lock down and the mandrel will no longer reciprocate within the barrel. This results in the tool being inoperative so that it must be removed from the hole and cleared before the process can continue.

This invention provides a square shoulder on the top of the knocker to greatly reduce the possibility of locking down in this area.

In addition, certain flow openings have restricted cross section area. This prevents the tool from taking too big of a slug of debris and being plugged by digging into the debris that it is seeking to remove. Also, the smaller cross sectional areas will tend to "jet" the liquid through the openings and cause additional turbulence which greatly increases the flushing of the sand and other debris away from the working parts.

(2) Objects of this Invention

An object of this invention is to clean sand and other debris from an oil well.

Another object of this invention is to provide a tool for cleaning sand from an oil well which is not susceptible to locking down because of sand contamination.

Further objects are to achieve the above with devices that are sturdy, compact, durable, lightweight, simple, safe, efficient, versatile, ecologically compatible, energy conserving, and reliable, yet inexpensive and easy to manufacture, connect, assemble, operate and maintain.

The specific nature of the invention, as well as other objects, uses, and advantages thereof, will clearly appear from the following description and from the accompanying drawing, the different views of which are not scale drawings.

Figure 1:
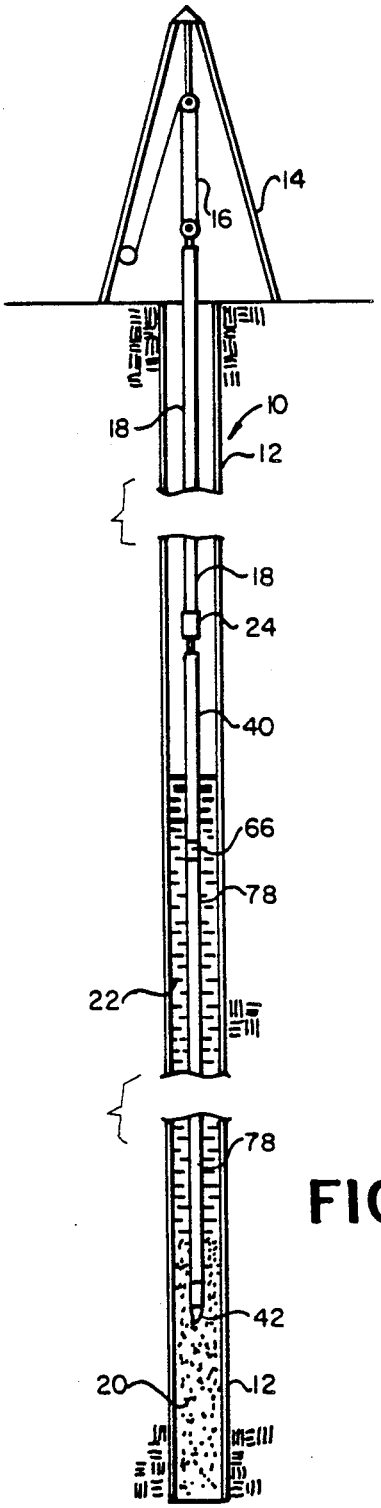
FIG. 1 is a schematic representation of an oil well with a sand pump of this invention in use therein.
Figure 2:
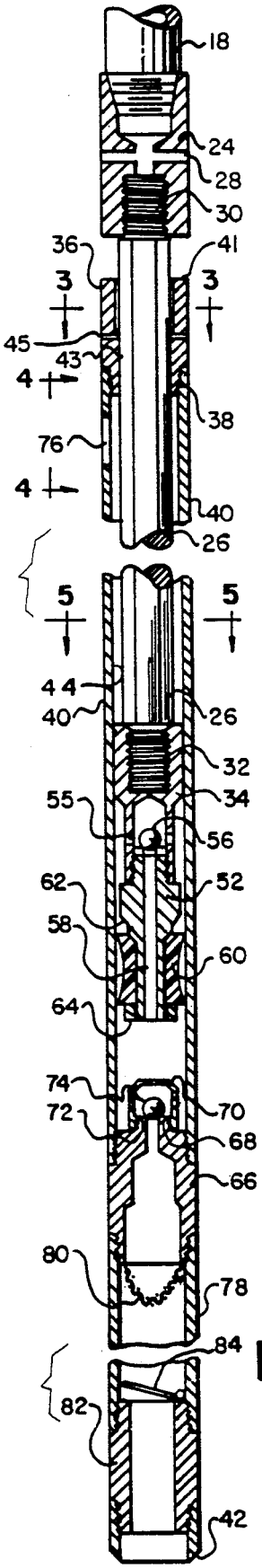
FIG. 2 is an axial sectional view of an embodiment of the invention.
Figure 4:
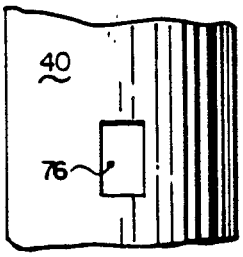
FIG. 4 is a side elevational view of the top slit taken substantially on line 4—4 of FIG. 2.

As an aid to correlating the terms of the claims to the exemplary drawing, the following catalog of elements and steps is provided:

10 well bore
12 casing
14 derrick
16 hoisting means
18 tubing string
20 sand
22 liquid
24 mandrel connection
26 mandrel
28 drain holes
30 upper pin, mandrel
32 lower pin, mandrel
34 knocker
36 barrel top fitting
38 external threads
40 barrel
41 top of top fitting
42 bottom head
43 hexagonal area
44 bore, barrel
45 holes 46 threaded cup, top
47 water courses
48 shoulder
50 threaded cup, bottom
52 swab holder
54 valve seat
55 fluid passages
56 ball
58 cylindrical portion
60 swab
62 flange
64 nut
66 tubular barrel transition
68 neck
70 ball check valve cage
72 valve seat
74 ball valve
76 slit
77 water course
78 tail pipe
80 screen
82 tubular bottom head holder
84 flapper valve

DESCRIPTION OF THE PREFERRED EMBODIMENT

Referring to the drawings, and particularly to FIG. 1, there may be seen an oil well. The well will include well bore 10 which extends from the surface of the earth to far beneath the surface of the earth. Casing 12 is in the bore 10. Derrick 14 is above the ground over the well bore. The derrick will include hoisting means 16 for raising, lowering, and reciprocating tubing string 18. The tubing string extends within the casing.

Also, within the well there will be sand 20. In addition to the sand 20, there will be liquid 22. The liquid might be in the form of liquid petroleum, mud, salt water, or a mixture of all three.

Mandrel connection 24 is attached to the bottom of tubing string 18. Mandrel 26 is connected to the mandrel connection 24. The mandrel connection will include drain holes 28. The drain holes will permit a free flow of liquid 22 into and out of the tubing string 18. A typical non-rounded or hexagonal mandrel is about 4' in length. The mandrel will have upper pin 30 machined and threaded on the top to thread into the mandrel connection 24 and lower pin 32 machined and threaded on the bottom so that the mandrel is attached to the knocker 34.

Figure 3:
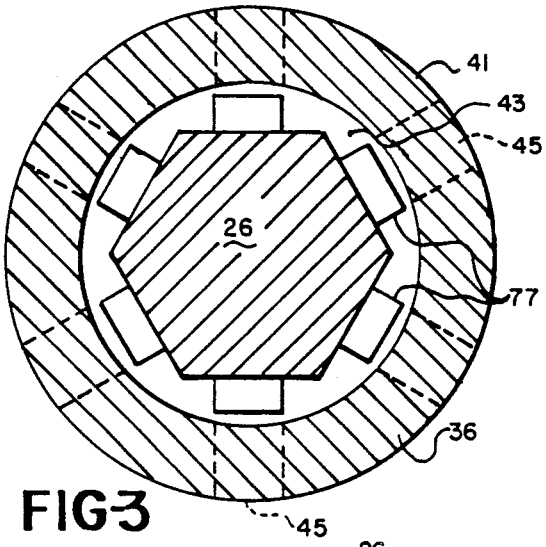
FIG. 3 is a cross sectional view taken substantially on line 3—3 of FIG. 2, showing a modified form of the invention.
Figure 5:
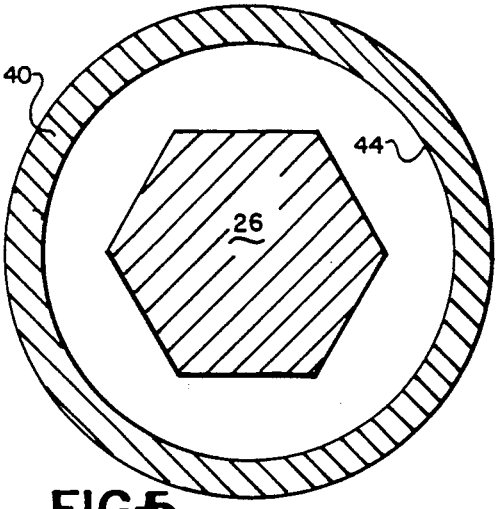
FIG. 5 is a cross sectional view taken substantially on line 5—5 of FIG. 2.
Figure 6:
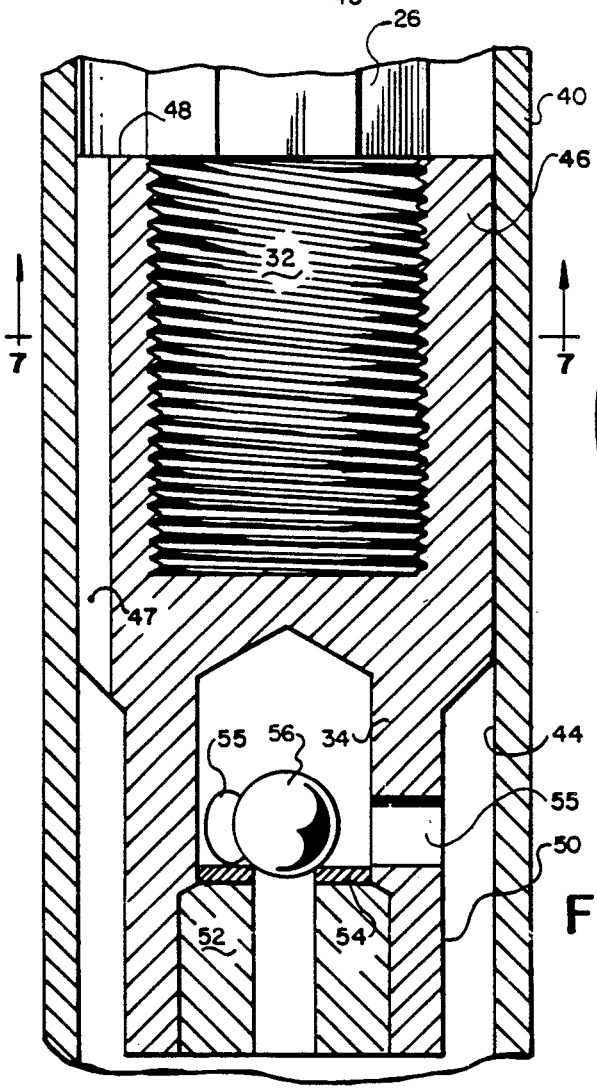
FIG. 6 is an enlarged detail of the knocker, it being an axial sectional view thereof.
Figure 7:
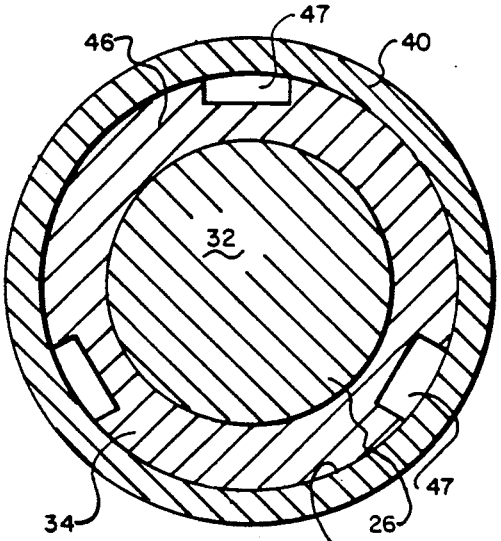
FIG. 7 is a cross sectional view taken substantially on line 7—7 of FIG. 6.

The mandrel 26 is telescoped within barrel top fitting 36. The barrel top fitting has external threads 38 on the bottom thereof to mate with internal threads at the top of barrel 40. As seen in the drawings, the mandrel 26 will have certain clearance between top 41 of the barrel top fitting and the mandrel. However, at about the lower half of the mandrel top fitting, the mandrel will have a hexagonal cross section area 43 as clearly seen in FIG. 3. I have found that it is desirable to have about 1/64" clearance between the sides. More particularly, with the mandrel measuring 2" across the flats, the hexagonal area 43 of the fitting 36 would measure 2.030" across the flats. With the mandrel telescoped through the hexagonal hole, it may be seen that if it desired to rotate the sand pump so as to rotate the bottom head 42, this may be readily accomplished by rotational equipment at the derrick, which has not been shown for clarity of the drawings.

As mentioned above, sand can settle within the top of the fitting where there are certain clearances. This sand will tend to settle between the mandrel and the close fitting hexagonal area 43. There is a possibility that downward movement of the hexagonal mandrel will draw the sand into the area and lock the tool down. To prevent this, plurality, such as six holes 45 are drilled to give the sand an opportunity to wash out of this area.

Typically, the barrel will have a 3" inside diameter or bore 44 therethrough.

It will be understood that for different wells of different depths will have different size well casing 12. Thus, there will be different sizes of cleanout equipment or sand pumps according to this invention, with different size holes, pumps, tubings, tolerances, and clearances. The dimensions particularly given here and discussed are for a tool having a 3" barrel bore 44. All of the dimensions given in this specification are for such one particular size tool. It will be understood that other tools would be used having different size barrel bores, mandrels, length of barrels, length of mandrels, etc.

The upper portion of the knocker 34 will have a threaded cup 46 therein which is threaded to the lower mandrel pin 32. The outside diameter of the knocker at this point will have about 1/64" clearance to the barrel bore 44. To provide water flow around this part of the knocker, three water courses 47 are milled on the outside surface. Each water course will be about ⅝" wide and ¼" deep.

It will be understood that the liquid, even at this point, will often have considerable number of grains of sand therein. Difficulty is sometimes experienced with the sand wedging between the outside perimeter or circumference of the knocker 34 and the barrel bore 44. I have found that if the top of the knocker is in the form of a shoulder 48 having a square edge, that the likelihood of sand wedging between the two is reduced. By square edge, it is meant that the top of the shoulder 48 is at right angles to the axis of the knocker.

The lower portion of the knocker 34 has threaded cup 50 into which swab holder 52 is threaded. Between the bottom cup 50 and the top cup 46, the knocker 34 forms a valve cage. Valve seat 54 is located within the knocker immediately adjacent to and above the top of the swab holder 52. Ball valve 56 seats upon this valve seat 54. Fluid passages 55 are provided between the valve seat 54 and the mandrel 26. I prefer to use three ½" diameter holes at this point.

I desire to use small diameter holes for two reasons. First, it is necessary the knocker have certain strength of material to hold the swabs; and therefore, it is desirable the material be weakened as little as possible in this area. Second, it is desired that in the pumping action, that the liquid be ejected from the holes at a high velocity. I have found that if the liquid is ejected from the holes at a high velocity, it will tend to flush sand from between the knocker and the bore more effectively than if a greater cross sectional area for ejection of the liquids from the holes were provided. Furthermore, I have found that there is less possibility of sand causing the pump to "lock down" if the holes are beneath the close clearance of the knocker to the barrel bore. The term "lock down" is used to indicate that the grains of sand are so tightly wedged between the knocker and the barrel bore that the mandrel can no longer be reciprocated within the barrel.

The swab holder 52 is tubular and has upper external threads by which it is attached to the bottom threaded cup 50 of the knocker 34. The lower portion of the swab holder has a cylindrical portion 58 upon which swab 60 is placed. Flange 62 is located upon the swab holder between the flange 62 and the cylindrical portion 58. This flange 62 holds the upper portion of the swab 60 in position. The lower portion of the swab is held in position by nut 64 threaded onto threads below the cylindrical portion 58.

I prefer to use a nonmetallic flexible rubber double action tubing swab, i.e., a swab has a lip on both ends so that it forms a fluid seal with the barrel bore on both ends and also wipes the barrel bore clean of grains of sand both on the up stroke and the down stroke. Inasmuch as the description of the tool to this point has been for a 3" tube, obviously a 3" double action tubing swab would be used, such as sold by Southwest Oil Field Products, Inc. of Houston, Tex.

Tubular barrel transition 66 has external threads on the top thereof by which the transition 6 is threadedly attached to internal threads on the bottom of the barrel 40. The barrel transition has an opening or bore therethrough and is therefore tubular. The top of the transition includes neck 68 having external threads thereon by which a ball check valve cage 70 is threadedly attached. The cage will enclose a valve seat 72 and ball valve 74. The cage 70 is open to freely permit the flow of fluid which comes through the valve seat 72.

Calculations will show that the cross sectional area of a 3" barrel bore is about 7.05 square inches. Also, calculations will show that the cross sectional area of a hexagonal mandrel 2" across the flaps will be about 3.45 square inches; which is about ½ the area of the barrel bore. Also, if the top slit 76, described later, is 1"×⅝", it will have a cross sectional area of 0.625 square inches. Also, a ½" diameter hole will have a cross sectional area of about 0.195 square inches. Therefore, the cross sectional area of the combined fluid passageways through the knocker, i.e., the three holes 55 through the knocker 34 will be about 0.59", which is less than the area of the top slit. Also, it may be seen that the cross sectional area of the top slit is about 1/10 the cross sectional area of the barrel bore.

In operation, when the mandrel goes from its lower most position to its upper most position, the ball valve 56 in the knocker will be closed; and therefore, the fluid between the mandrel 26 and the barrel bore 44 will be expelled from the barrel bore through top slit 76 and between the barrel top fitting 36 and the mandrel 26. Since the mandrel will occupy half of the volume within the bore, half the total volume capacity of the bore will be liquid which are expelled in the up stroke. Also, since the ball 56 is closed, no liquid will flow through the openings or fluid passages 55.

On the down stroke of the mandrel 26, the ball check valve 74 will be closed; and therefore, no fluid will escape from the bottom of the barrel bore 44. As the swab 60 moves downward, all of the liquid, which would be the entire volume of the liquid within the bore 44, will pass through the fluid passages 55. Also, upon reaching the complete down stroke, the liquid will occupy only the annulus between the mandrel 26 and the bore 44. Therefore, on the down stroke, ½ the total volume of the barrel bore will also be expelled through the top slit 76 and between the mandrel and the barrel top fitting 36. I.e., both on the down stroke and up stroke, liquid will be flushed clean, any sand which might be accumulated around the barrel top fitting. Also, this means that on each down stroke, there will be a rapid flow of fluid through the fluid passageways 55. By having the openings small, the fluid will be jetted out of the openings, causing turbulence between the threaded cup 46 of the knocker and the top of the swab 60. This turbulence is desired to flush sand from this area each down stroke.

Also, it may be seen that on each down stroke, the entire volume of fluid must flow through the three water courses 47 in the cup 46 of the knocker 34. Each of these water courses will have a cross sectional area of about 0.156 square inches; and therefore, the three of them together will have a cross sectional area of about 0.47 square inches, less than the cross sectional area of the combined fluid passages 55. Therefore, these will be considerable turbulence at the top around the square shoulders 48.

The outside diameter of the mandrel connection 24 is larger than the inside diameter of the barrel top fitting 36 at the top of the barrel top fitting. Therefore, the mandrel connection and the barrel top fitting will form means to limit the downward travel of the mandrel within the barrel. Obviously, it is desirable that this downward travel be limited so that the cage 70 is not damaged by the downward travel of the bottom of the swab holder 52. Likewise, the square shoulder 48 of the knocker 34 has a greater outside diameter than the inside diameter of the bottom of the barrel top fitting 36 so that the upward travel is limited.

The slit 76 is a restricted opening at the top of the barrel. This restricted opening could take the form of water courses 77 cut in the horizontal flats of the hexagonal area 43 in the top fitting 36.

The slit 76 is located in the barrel adjacent to the top thereof, i.e., adjacent to the fitting 36. Preferable, this slit is about 1" long and ⅝" wide. The slit is made to restrict the flow of the fluid produced by the upward stroke of the swab 60 within the barrel bore 44. The limitation of the speed or velocity of the stroke will prevent rough handling of the equipment. More important, it will also limit the in flow of sand and debris into the bottom head 42. It will be understood that if it is permitted for a large slug of sand and debris to enter the bottom head, if the bottom head is in the form of an open shoe, that this large slug of material will plug the tool, making further pumping impossible. It will be understood that to successfully pull the sand and debris within the tool through the bottom head, it is necessary that the sand and debris be suspended within the liquid 22 rather than present in large slugs. Therefore, it is desirable to limit the upward velocity of the swab 60, and I have found that making a restrictive slit 76, is an inexpensive a reliable way to accomplish this goal.

The lower portion of the tubular barrel transition 66 has external threads by which tail pipe 78 is attached. The tail pipe 78 is a series of tubing joints; the same as are used upon the tubing string 18, the distinction being that the tubing string 18 is above the barrel 40 and the tail pipe 78 is below the barrel 40. It is desirable that the tubing string be a sufficient length to contain all of the sand 20 which may be within the well, and also have additional sufficient length as a safety factor in the event that the amount of sand is incorrectly estimated. Also, it is desired that when all the sand is pulled into the tail pipe 78 that there still be a liquid space within the tail pipe above the sand. As near as possible, this permits the sand to settle out from the liquid within the tail pipe. However, realistically, this will never be possible, and there will always be a certain amount of sand which passes on through the bottom head 42 into the barrel bore 44. Screen 80 is optionally placed on the bottom of the transition 66 to prevent larger pieces of debris, such as chopped up rubber, from flowing into the barrel bore 44. The screen makes no attempt to separate the sand; the sand being too fine to be screened out.

Another criteria for the length of the tail pipe 78 is that the tail pipe must have enough weight within the liquid 22 so that the weight of the tail pipe and the liquid is greater than the friction of the swab 60 upon the barrel bore 44. It will be understood that the material which the tail pipe is constructed will have a greater density than that of the liquid 22 within the well. Therefore, the weight of the tail pipe within the liquid will be less than the weight of the tail pipe within air. It will b understood that if the tail pipe were extremely light, such as only 30′ of the tail pipe, that the friction of the swab against the barrel bore would be sufficient to lift the entire tail pipe assembly with the upward movement of the swab, in which case, no pumping action would occur.

Normally, it is desirable that the barrel 40 be beneath the liquid level or only slightly above it. However, it will be understood, that with the ball valve 74 at the top of the tail pipe, that liquid 22 can be raised a considerable distance within the tail pipe, i.e., that although normally liquid can only be raised about 10′.

Tubular bottom head holder 82 has external threads thereon. These external threads are threaded within the bottom joint of tubing forming the tail pipe 78.

The bottom of the tubular bottom head holder also has external threads by which the bottom head 42 may be attached.

It may be understood that the bottom head might be in the form of various types tools as have been used in the prior art such as shoes, drill bits, notched collars, or a packer retrieving head.

Flapper valve 84 is attached to the top of the tubular bottom head holder. As has been known in the prior for many years, the flapper valve is the preferred type of valve at the bottom of the sand pump or any well cleanout tool.

The cross sectional area of the casing will probably be at least five times as large as the cross sectional area of the bore of the tail pipe. Therefore, it may be seen that to remove the same volume of sand and debris from the well, it will take at least five times the linear distance within the tail pipe as within the casing; i.e., if there is 10′ of debris within the casing, it would require more than 50′ of tail pipe to contain the sand. Inasmuch as it is not unusual for wells to have over 50′ of debris within them, it may be seen that it is not unusual for tail pipes to have a length of 300′–400′.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. Cleanout equipment for cleaning debris from an oil well which includes a. a well bore extending far beneath the surface of the earth, b. casing in the bore, c. a tubing string in the casing, d. a derrick above ground over the well bore, e. hoisting means on the derrick connected to the tubing string for raising, lowering, and reciprocating the tubing string, and f. liquid in the well;

g. wherein said cleanout equipment comprises in combination with the above:

h. a mandrel connection threadedly attached to the bottom of said tubing string, hh. said mandrel connection having drain holes therethrough, hhh. said drain holes fluidly connected to the inside of the tubing string so that liquid may freely pass into and out of the tubing string, j. a hexagonal mandrel attached to the mandrel connection and slidingly telescoped through k. a barrel top fitting having a hexagonal bore below a cylindrical bore, kk. holes through the barrel top fitting at the top of the hexagonal bore, the barrel top fitting threadedly attached to the top of l. a barrel having a barrel bore, m. a double action swab reciprocatingly within said barrel bore mounted on n. a tubular swab holder, o. a knocker threadedly attached to the swab holder and the mandrel, thus attaching the swab to the mandrel, p. the knocker having therein i. a valve seat adjacent the swab holder, ii. a ball valve, and iii. fluid passages through the knocker between the valve seat and the mandrel, q. so that liquid may pass through the tubular swab holder, valve seat, and fluid passages into an annular space between the mandrel and barrel, qq. a square shoulder on said knocker at the mandrel, qqq. the outside diameter of said shoulder being greater than the inside diameter of the barrel top so that the upward travel of the mandrel is limited, and so that sand may be flushed away from the top of the knocker, qqqq. the fluid passages in the knocker on the mandrel form restricted passages so that the fluid flowing from the knocker has sufficient velocity to flush debris from the swab, the knocker and its square shoulder, r. a restricted passsageway at the top of the barrel forming means for limiting the velocity of travel of the mandrel by the passage of liquid through the restricted passageway thereby preventing overload of too much debris, s. a tubular barrel transition threadedly attached to the bottom of the barrel, t. a tail pipe threadedly attached to the barrel transition, u. a tubular head holder threadedly attached to the tail pipe, v. a flap valve on the head holder, and w. a bottom head threadedly attached to the bottom of the head holder, x. the cross sectional area of the mandrel being about half the cross sectional area of the barrel bore, y. the cross sectional area of the restricted passage at the top of the barrel being about 1/10 the cross sectional area of the barrel bore, and z. the cross sectional area of the combined fluid passages through the knocker being less than about 1/10 the cross sectional area of the barrel bore.

2. The invention as defined in claim 1 further comprising:

aa. a valve cage with a ball valve therein attached to the top of said tubular barrel transition to permit fluid to flow upward from the tail pipe into the barrel and to prevent fluid from flowing downward from the barrel into the debris tubing, and bb. a screen on the bottom of the tubular barrel transition to prevent large debris from flowing upward into the barrel bore.

* * * * *